US009574434B2

(12) United States Patent
Albrecht et al.

(10) Patent No.: US 9,574,434 B2
(45) **Date of Patent: *Feb. 21, 2017**

(54) MONITORING SYSTEM FOR WELL CASING

(71) Applicant: SHELL OIL COMPANY, Houston, TX (US)

(72) Inventors: Michele Scott Albrecht, Houston, TX (US); Jeremiah Glen Pearce, Houston, TX (US); Frederick Henry Kreisler Rambow, Houston, TX (US); David Ralph Stewart, Richmond, TX (US)

(73) Assignee: SHELL OIL COMPANY, Houston, TX (US)

( * ) Notice: Subject to any disclaimer, the term of this patent is extended or adjusted under 35 U.S.C. 154(b) by 139 days.

This patent is subject to a terminal disclaimer.

(21) Appl. No.: 14/617,720

(22) Filed: Feb. 9, 2015

(65) Prior Publication Data

US 2015/0176391 A1 Jun. 25, 2015

Related U.S. Application Data

(63) Continuation of application No. 13/060,465, filed as application No. PCT/US2009/054949 on Aug. 26, 2009, now Pat. No. 8,973,434.

(60) Provisional application No. 61/092,168, filed on Aug. 27, 2008.

(51) Int. Cl.
*E21B 47/01* (2012.01)
*E21B 47/00* (2012.01)

(52) U.S. Cl.
CPC ..... *E21B 47/0006* (2013.01); *E21B 47/01* (2013.01)

(58) Field of Classification Search
CPC ..... E21B 47/01; E21B 47/0006; E21B 49/006
See application file for complete search history.

(56) References Cited

U.S. PATENT DOCUMENTS

| | | | | |
|---|---|---|---|---|
| 4,004,832 A | | 1/1977 | Connelly | |
| 4,073,511 A | | 2/1978 | Haas et al. | |
| 4,083,230 A | | 4/1978 | Rome et al. | |
| 4,599,904 A | | 7/1986 | Fontenot | |
| 4,654,520 A | | 3/1987 | Griffiths | |
| 4,812,645 A | * | 3/1989 | Griffiths | G01B 11/18 250/227.14 |
| 4,927,232 A | * | 5/1990 | Griffiths | G01B 11/18 250/227.24 |
| 4,930,852 A | | 6/1990 | Wheeler et al. | |

(Continued)

FOREIGN PATENT DOCUMENTS

| | | |
|---|---|---|
| DE | 19913113 | 10/2000 |
| GB | 1570511 | 7/1980 |

OTHER PUBLICATIONS

PCT International Search Report, Application No. PCT/US2009/054979 dated Oct. 15, 2009.

*Primary Examiner* — John Fitzgerald

(57) ABSTRACT

A system for use in a wellbore, comprises a length of casing, a structure that is configured to deform with deformation of the casing, said structure being affixed to the length of casing at substantially the same radial position along the length of casing, and a sensing device that is configured to measure deformation of the structure, said device comprising a plurality of sensors that are distributed with respect to at least one of the length of said structure and the periphery of said structure.

16 Claims, 3 Drawing Sheets

(56) References Cited

U.S. PATENT DOCUMENTS 5,026,141 A 6/1991 Griffiths
5,551,484 A 9/1996 Charboneau
5,661,246 A * 8/1997 Wanser ..... G01L 1/242 356/30
5,745,232 A 4/1998 Hasegawa
5,798,521 A 8/1998 Froggatt
5,845,033 A 12/1998 Berthold et al.
6,233,374 B1 5/2001 Ogle et al.
6,252,656 B1 6/2001 Wu et al.
6,346,702 B1 2/2002 Davis et al.
6,354,147 B1 3/2002 Gysling et al.
6,358,618 B1 3/2002 Grossman
6,363,089 B1 3/2002 Fernald et al.
6,426,496 B1 7/2002 Froggatt et al.
6,450,037 B1 9/2002 McGuinn et al.
6,580,033 B1 6/2003 Goldner et al.
6,840,114 B2 1/2005 Niezgorski et al.
6,854,327 B2 2/2005 Rambow et al.
6,882,595 B2 4/2005 Woo
6,957,574 B2 10/2005 Ogle
6,959,604 B2 11/2005 Bryant et al.
7,113,091 B2 9/2006 Script et al.
7,121,342 B2 10/2006 Vinegar et al.
7,194,913 B2 3/2007 Morrison et al.
7,245,791 B2 7/2007 Rambow et al.
7,277,162 B2 10/2007 Williams
7,302,139 B1 11/2007 Ames
7,357,180 B2 4/2008 Vinegar et al.
7,398,697 B2 7/2008 Allen et al.
7,409,858 B2 8/2008 Dria et al.
7,461,561 B2 12/2008 Morrison et al.
7,471,860 B2 12/2008 Coronado et al.
7,597,142 B2 10/2009 Hartog et al.
7,646,945 B2 1/2010 Jones et al.
7,896,069 B2 3/2011 Dria et al.
7,954,560 B2 6/2011 Mathiszik et al.
8,131,121 B2 3/2012 Huffman
8,316,936 B2 * 11/2012 Roddy ..... E21B 43/25 166/253.1
8,380,021 B2 2/2013 Rambow
8,532,942 B2 9/2013 Pearce et al.
8,973,434 B2 * 3/2015 Albrecht ..... E21B 47/01 73/152.57
2002/0158866 A1 10/2002 Batchko
2003/0007442 A1 1/2003 Henrichs
2003/0217605 A1 11/2003 Croteau et al.
2004/0035216 A1 2/2004 Morrison et al.
2004/0065437 A1 4/2004 Bostick et al.
2004/0096614 A1 * 5/2004 Quigley ..... B29C 70/086 428/36.3
2004/0140095 A1 7/2004 Vinegar et al.
2004/0140096 A1 7/2004 Sandberg et al.
2004/0144540 A1 7/2004 Sandberg et al.
2004/0144541 A1 7/2004 Picha et al.
2004/0145969 A1 7/2004 Bai et al.
2004/0146288 A1 7/2004 Vinegar et al.
2004/0168794 A1 9/2004 Vold
2004/0177966 A1 9/2004 Vinegar et al.
2004/0179841 A1 9/2004 Shahar
2004/0231429 A1 11/2004 Niezgorski et al.
2005/0006097 A1 1/2005 Sandberg et al.
2005/0051327 A1 3/2005 Vinegar et al.
2005/0215764 A1 9/2005 Tuszynski et al.
2005/0274194 A1 12/2005 Skinner et al.
2006/0045408 A1 3/2006 Jones et al.
2006/0071158 A1 4/2006 Van Der Spek
2006/0115335 A1 * 6/2006 Allen ..... E21B 17/01 405/274
2006/0151042 A1 * 7/2006 Stringfellow ..... F16L 11/12 138/125
2006/0230839 A1 * 10/2006 Morrison ..... E21B 17/015 73/800
2006/0233482 A1 10/2006 Rambow
2007/0068262 A1 3/2007 Skinner et al.
2007/0131411 A1 6/2007 Vinegar et al.
2007/0258674 A1 11/2007 Wang et al.
2007/0289741 A1 12/2007 Rambow
2008/0047662 A1 2/2008 Dria et al.
2008/0142212 A1 6/2008 Hartog et al.
2008/0181555 A1 7/2008 Head
2008/0271926 A1 11/2008 Coronado et al.
2009/0217769 A1 9/2009 Roberts
2009/0254280 A1 10/2009 Stoesz
2009/0296086 A1 12/2009 Appel et al.
2010/0200743 A1 8/2010 Forster et al.
2010/0200744 A1 8/2010 Pearce et al.
2010/0254650 A1 10/2010 Rambow
2011/0054808 A1 3/2011 Pearce et al.
2011/0185807 A1 * 8/2011 Albrecht ..... E21B 47/01 73/152.57
2012/0132007 A1 * 5/2012 Dria ..... E21B 47/0005 73/760
2012/0132417 A1 * 5/2012 Dria ..... E21B 47/065 166/250.01
2012/0136577 A1 * 5/2012 Dria ..... E21B 47/0006 702/11
2012/0155508 A1 * 6/2012 Dria ..... E21B 43/164 374/107
2013/0094798 A1 * 4/2013 Duncan ..... E21B 47/0006 385/13

* cited by examiner

Fig. 3
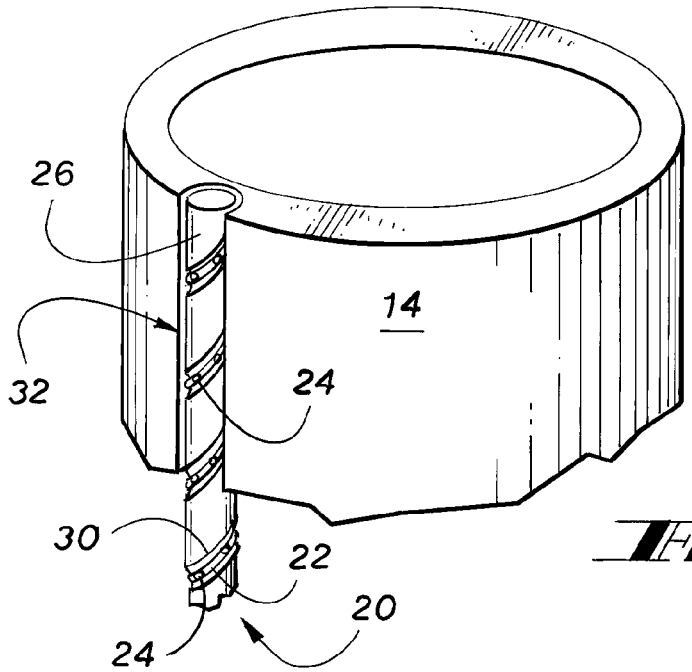
Fig. 4
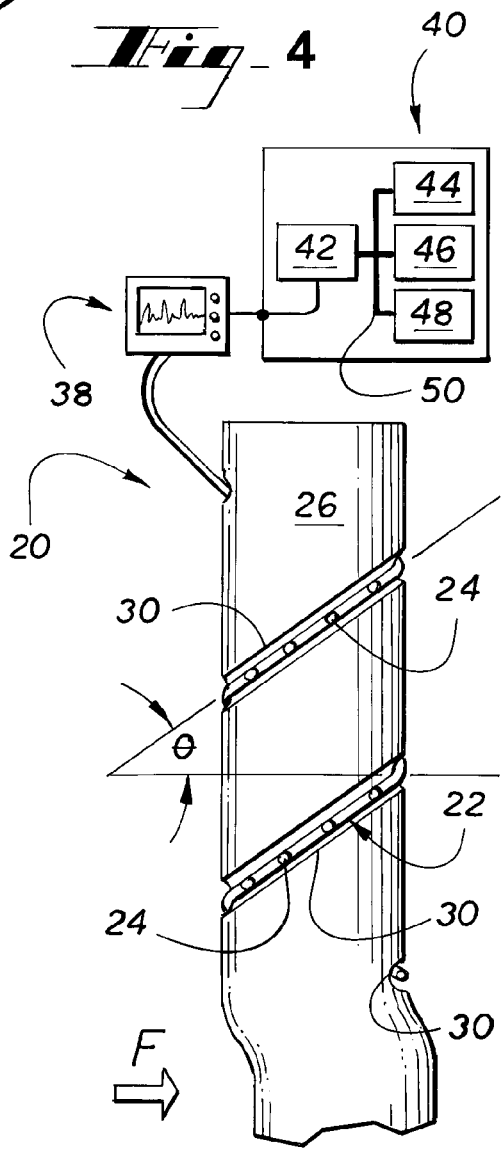
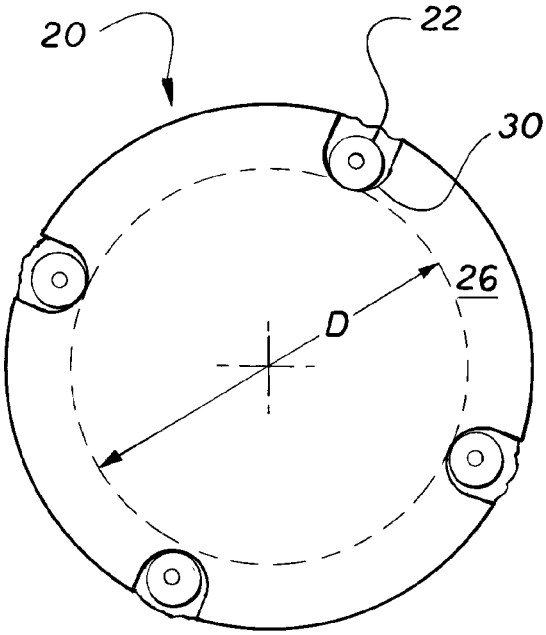
Fig. 5

MONITORING SYSTEM FOR WELL CASING

REFERENCE TO EARLIER APPLICATION

The present application is a continuation application claiming priority of prior-filed U.S. application Ser. No. 13/060,465, filed Apr. 25, 2011, which claims priority from PCT/US2009/054949, filed 26 Aug. 2009, which claims priority from U.S. Provisional Application 61/092,168, filed 27 Aug. 2008.

TECHNICAL FIELD

This invention relates generally to systems and methods for detecting deformation and, more specifically, to systems and methods of detecting deformation of a casing that reinforces a well in a formation.

BACKGROUND

Electromagnetic investigation tools are often used to take measurements at points along the length of a borehole in an earth formation. Wells in formations are commonly reinforced with casings, well tubulars, or production tubing that prevents the wells from collapsing. However, forces applied by the formation may cause the casing to bend, buckle, elongate, ovalize or otherwise deform. Where the deformation results in a significant misalignment of the well axis, the production that can be gained from the well can be partially or completely lost. In each case, additional time and expense is necessary to repair or replace the well. The ability to detect an early stage of deformation would allow for changes in production practices and remedial action.

In addition, casings are often perforated with guns to let oil or gas into a well. Certain types of guns perforate a casing before the casing is placed in a well and other types of guns can perforate a casing that has been placed in a well. Systems for monitoring deformation that include elements that are wrapped around the casing may obstruct casing perforations or may be damaged as a casing is perforated. There is a need for the ability to both monitor the deformation of a casing and perforate the casing.

SUMMARY

The present disclosure provides a system and method for detecting and monitoring deformation of a casing that is configured to reinforce a wall of a well in a formation. An exemplary system for monitoring deformation of a casing includes a structure configured to deform along with deformation of the casing and a device that is configured to measure the deformation of the structure. The system monitors the deformation of the casing and permits the casing to be perforated without risking damage to the system.

According to an exemplary embodiment, the structure is attached to the casing such that the structure is in contact with a surface of the casing. A bonding material or straps can be used to attach the structure to the casing. In another exemplary embodiment, a rigid member connects the structure to the casing and causes the structure to deform along with deformation of the casing. In another exemplary embodiment, the structure is integral with the casing.

The exemplary structure is configured to extend along at least a portion of the length of the casing. For example, the structure and the casing can have substantially parallel longitudinal axes. As the structure has substantially the same radial position along the length of the casing, the casing can be perforated at other radial positions away from the structure.

In certain embodiments, each of the casing and the structure is elongated. For example, the casing can include a tube, cylindrical object, or cylinder and the structure can include a rod, tube, cylinder, fin cable, wire, rope, or beam. Neither the casing nor the structure is limited to a particular shape. The diameter or perimeter width of the structure can be less than the diameter or perimeter width of the casing. For example, where the device includes a string of sensors, a structure with a smaller perimeter reduces the amount of strain on the string where the string is wrapped around the structure. Further, the diameter or perimeter width of the structure can be selected to optimize the sensitivity of the system to strain.

According to an exemplary embodiment, the device includes string of sensors that are distributed with respect to the length and perimeter of the structure. The string is wrapped around the structure such that sensors are distributed along both the length and the perimeter of the structure. For example, the string can be helically wrapped around the structure. In certain embodiments, the structure includes a groove and the string is recessed in the groove to reduce the risk of damage to the string. As the string and the structure can be pre-assembled before attaching to a casing, the string can be received in the groove rather than threaded through the groove after the structure is attached to the casing.

According to an exemplary embodiment, the string includes optical fibers and the sensors include periodically written wavelength reflectors. For example, the wavelength reflectors are reflective gratings such as fiber Bragg gratings. The string provides a wavelength response that includes reflected wavelengths corresponding to sensors. Each reflected wavelength is substantially equal to the sum of a Bragg wavelength and a change in wavelength. The change in wavelength corresponds to a strain measurement.

Deformation of the casing includes bending of the casing and axial strain of the casing. To relate the deformation of the structure and deformation of the casing, the structure can be configured such that the radius of curvature of the structure is a function of the radius of curvature of the casing and such that the axial strain of the structure is a function of the axial strain of the casing.

The system further includes a data acquisition unit and a computing unit for collecting and processing data measured by the device. In certain embodiments, the device is configured to measure strain and or temperature.

An exemplary method of detecting deformation of a casing includes processing measurements that represent deformation of a structure that is configured to deform along with deformation of the casing. For example, the measurements can be strain measurements taken at a plurality of positions on the structure. The measurements can be processed to determine values of parameters that can be used to determine information about the deformation of the casing. For example, values of bending angle, axial strain, and radius of curvature of the structure can be used to determine values of these parameters for the casing which can be used to determine values of strain at locations on the casing. A memory or computer readable medium includes computer executable instructions for execution of the method.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 3 is a partial perspective view of the casing and system of FIG. 1.

FIG. 4 is a partial side view of the system of FIG. 1.

FIG. 5 is a plan view of a system, according to a second exemplary embodiment of the present invention.

DETAILED DESCRIPTION OF THE INVENTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Systems and methods are described herein in the context of determining deformation of a casing that supports the wall of a well although the teachings of the present invention may be applied in environments where casings elongate, bend, or otherwise deform. Typically, casings are cylindrical objects that support the wall of a well such as but not limited to well bore tubulars, drill pipes, production tubes, casing tubes, tubular screens, sand screens, and the like.

The systems and methods taught herein can be used to detect and monitor deformation of a casing in a borehole during production or non-production operations such as completion, gravel packing, frac packing, production, stimulation, and the like. The teachings of the present disclosure may also be applied in other environments where pipes expand, contract, or bend such as refineries, gas plants, and pipelines.

As used herein, the term cylindrical is used expansively to include various cross sectional shapes including a circle, a square, a triangle, a polygon, and the like. The cross section of a casing is not necessarily constant along the length of the casing. Casings may or may not have a hollow interior.

Herein, like-elements are referenced in a general manner by the same element reference, such as a numeral or Greek letter. A suffix (a, b, c, etc.) or subscript (1, 2, 3, etc.) is affixed to an element reference to designate a specific one of the like-elements. For example, radius of curvature $R_1$ is the radius of curvature R of casing 14.

Well

Figure 2:
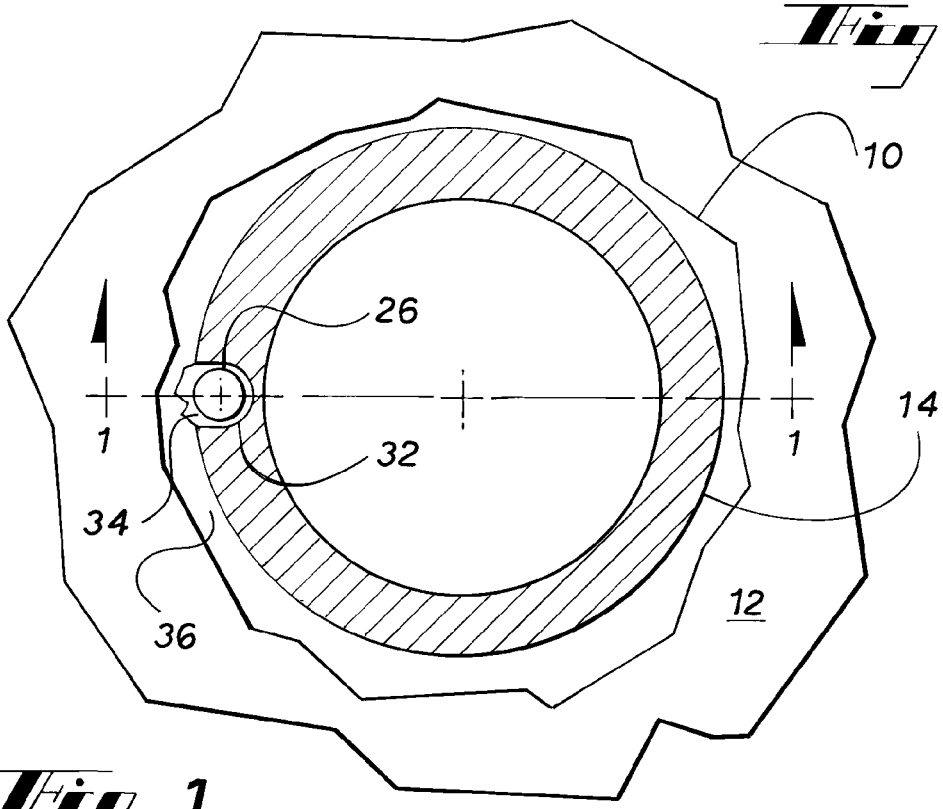
FIG. 2 is a partial plan view of the well of FIG. 1.
Figure 1:
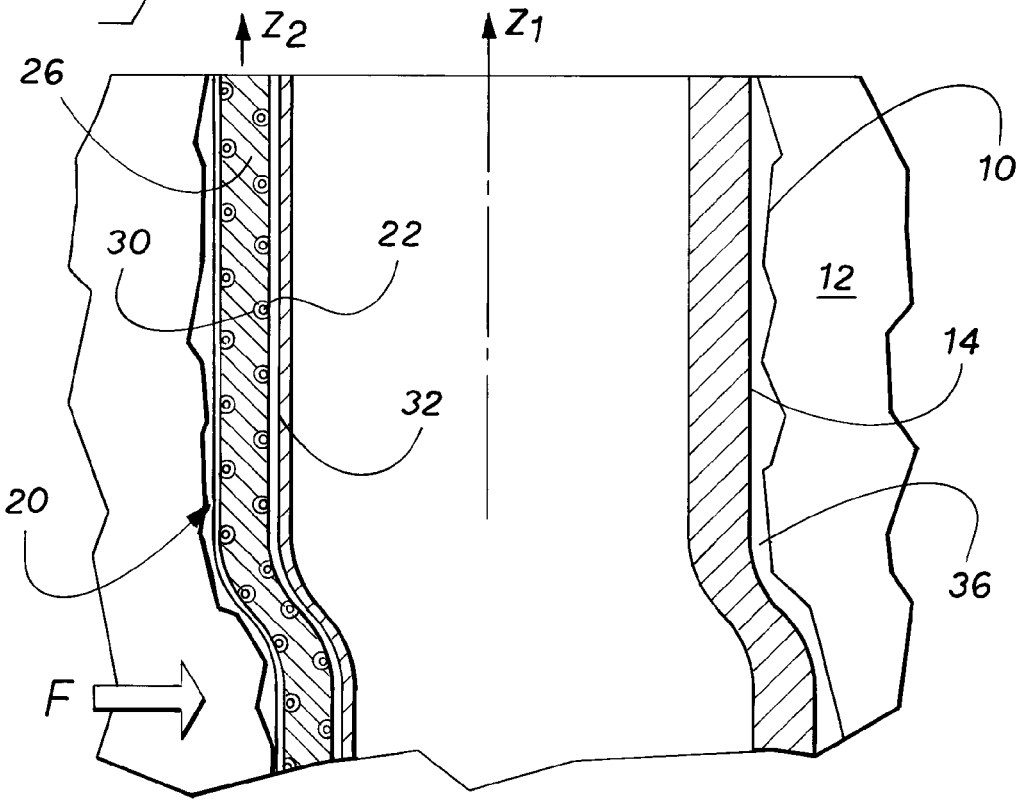
FIG. 1 is a partial cross-sectional side view of a well reinforced with a casing and a system for monitoring deformation of the casing, according to a first exemplary embodiment of the present invention.

Referring to FIGS. 1 and 2, a well 10 is drilled in a formation 12. To prevent well 10 from collapsing or to otherwise line or reinforce well 10, a casing 14 is formed in well 10. In the exemplary embodiment, casing 14 is formed from steel tubes that are inserted into well 10.

System

Referring to FIGS. 1-5, an exemplary system 20 for detecting deformation of casing 14 includes a structure 26 that is configured to deform along with deformation of casing 14 and a device that is configured to measure deformation of structure 26. The illustrated embodiment comprises a string 22 of strain sensors 24 that is wrapped around structure 26. The sensors 24 are distributed along the length and around the periphery of structure 26.

In alternative embodiments, sensors 24 can be supported on or in a sleeve or sheath that is placed around the outside of the structure, the sensors can be embedded in the structure, or the sensors can be supported by any other suitable means that permits the device to measure the deformation of the structure.

It is important that structure 26 is affixed to or associated with casing 14 in such a way that deformation of the casing causes a corresponding deformation of the structure. For purposes of discussion, the term "affixed" will be used herein to describe the relationship between the casing and the structure, regardless of whether the structure is directly or indirectly attached to the casing or merely in contact with the casing.

Structure

In the illustrated embodiment, structure 26 is an extruded metal form with a diameter that is less than the diameter of casing 14. In alternative embodiments, structure 26 can include a rod, a tube, a cable, a wire, a rope, a beam, a fin, combinations thereof, and the like. Structure 26 can be formed from various materials so as to have a rigidity and elasticity that permits structure 26 to deform with the deformation of casing 14. The wrap diameter D of structure 26 can be selected with respect to a desired output of system 20 as the sensitivity of system 20 to bending measurements is a function of the wrap diameter D of structure 26.

Structure 26 preferably has substantially the same radial position along the length of the casing. This allows the casing to be perforated at other radial positions away from structure 26, thereby avoiding damaging the structure.

String of Interconnected Sensors

There are many different suitable types of strings 22 of sensors 24 that can be associated with system 20. For example, string 22 can be a plain fiber or grating fiber and can be protected with a coating such as polymide, peek, or a combination thereof. In the first exemplary embodiment, string 22 is a waveguide such as an optical fiber and sensors 24 can be wavelength-specific reflectors such as periodically written fiber Bragg gratings (FBG). An advantage of optical fiber with periodically written fiber Bragg gratings is that fiber Bragg gratings are less sensitive to vibration or heat and consequently are far more reliable.

In alternative embodiments, sensors 24 can be other types of gratings, semiconductor strain gages, piezoresistors, foil gages, mechanical strain gages, combinations thereof, and the like. Sensors 24 are not limited to strain sensors. For example, in certain applications, sensors 24 are temperature sensors.

Structure Groove

Referring to FIGS. 4 and 5, structure 26 preferably includes a groove 30 and string 22 is received in groove 30 to decrease the risk of damage to string 22. For example, groove 30 prevents string 22 from being crushed. Once string 22 is received in groove 30, groove 30 may be filled with a bonding material such as adhesive to secure string 22 in groove 30 and further protect string 22. The adhesive can be high temperature epoxy or ceramic adhesive. Alternatively, structure 26 can be covered with a protective coating, such as a plastic coating, or inserted into a sleeve, such as a tube, to retain string 22 in groove 30 and provide additional crush protection.

Wrap Angle

An exemplary arrangement of string 22 with respect to structure 26 is now described. The description of the arrangement of string 22 is applicable to the arrangement of groove 30, as string 22 is received in groove 30. In other words, string 22 and groove 30 are arranged to follow substantially the same path.

In the illustrated embodiments, string 22 is substantially helically wrapped around structure 26. String 22 is arranged at a substantially constant inclination, hereinafter referred to as a wrap angle 0. In general, wrapping string 22 at an angle is beneficial in that string 22 only experiences a fraction of the strain experienced by structure 26. Wrap angle $\theta$ can be selected according to a range of strains that system 20 is likely to encounter or designed to measure. Wrap angle $\theta$ can also be selected to determine the resolution of sensors 24 along the length and around the circumference of structure 26, which can facilitate qualitative and quantitative analysis of a wavelength responses $\lambda_{n,2}$, as described in further detail below.

Casing Groove

Referring to FIGS. 1-3, casing 14 includes a groove 32 that is configured to receive structure 26. The illustrated groove 32 is formed in the outer wall of casing 14, extends along the length of casing 14, and is substantially parallel to the longitudinal axis of casing 14. In alternative embodiments, groove 32 is formed in the inner wall of casing 14. As structure 26 is received in groove 32, structure 26 is in contact with casing 14 such that structure 26 deforms along with casing 14. Structure 26 can be held in groove 32 or otherwise attached to casing 14 with a bonding material 34 (see FIG. 1) such as adhesive or cement. Additionally or alternatively, straps can be used to retain structure 26 in groove 32. In still other embodiments, groove 32 can be eliminated and structure 26 affixed to the exterior or interior of casing 14.

Continuing with FIGS. 1 and 2, with structure 26 received in groove 32, cement is pumped between casing 14 and formation 12 to provide a cement sheath 36. Cement sheath 36 fills the space between casing 14 and wellbore 10 thereby coupling casing 14 to formation 12 and securing the position of casing 14.

Referring to FIG. 4, system 20 further includes a data acquisition unit 38 and a computing unit 40. Data acquisition unit 38 collects the response of string 22. The response and/or data representative thereof is provided to computing unit 40 to be processed. Computing unit 40 includes computer components including a data acquisition unit interface 42, an operator interface 44, a processor unit 46, a memory 48 for storing information, and a bus 50 that couples various system components including memory 48 to processor unit 46.

Coordinate System

Figure 6:
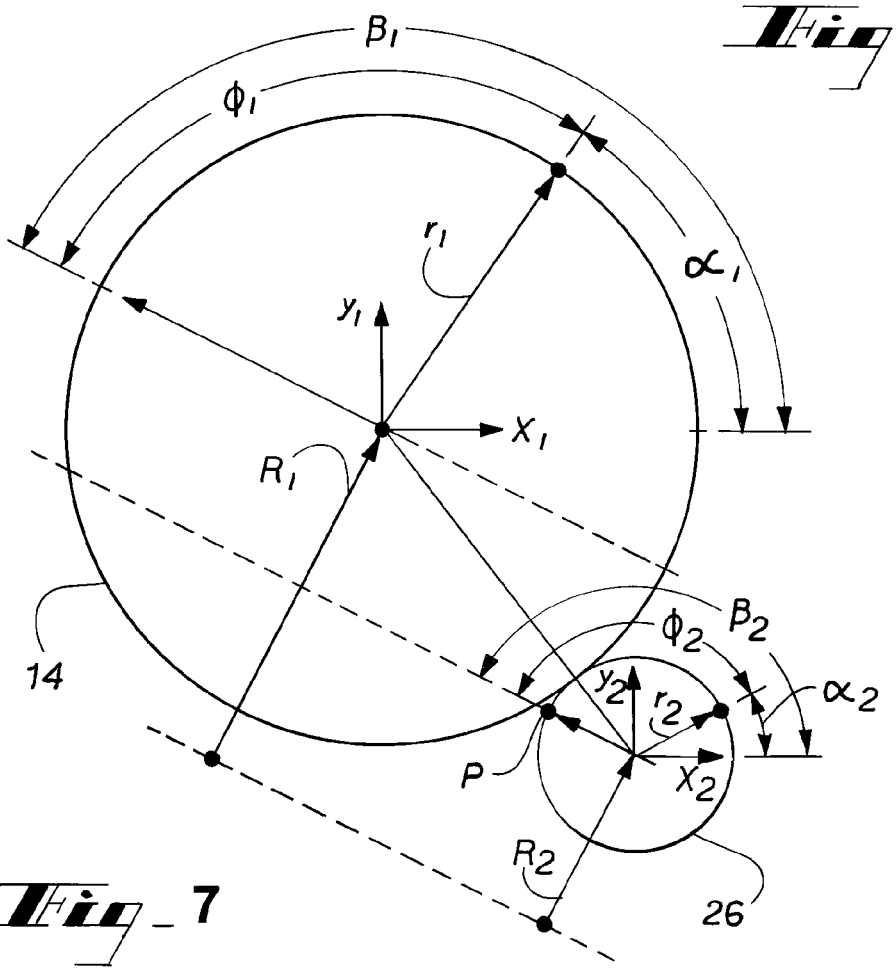
FIG. 6 is a schematic plan view of the casing and system of FIG. 1 illustrating an exemplary coordinate system.

Referring to FIGS. 1 and 6, for purposes of discussion, exemplary coordinate systems are now described. A Cartesian coordinate system can be used where an x-axis, a y-axis, and a z-axis (FIG. 1) are orthogonal to one another. The z-axis preferably corresponds to the longitudinal axis of casing 14 or structure 26 and any position on casing 14 or structure 26 can be established according to an axial position along the z-axis and a position in the x-y plane, which is perpendicular to the z-axis.

In the illustrated embodiment, each of casing 14 and structure 26 has a substantially circular cross section and any position on casing 14 and structure 26 can be established using a cylindrical coordinate system. Here, the z-axis is the same as that of the Cartesian coordinate system and a position lying in the x-y plane is represented by a radius r and a position angle $\alpha$. Herein, a position in the x-y plane is referred to herein as a radial position $r\alpha$ and a position along the z-axis is referred to as an axial position. Radius r defines a distance of the radial position $r\alpha$ from the z-axis and extends in a direction determined by position angle $\alpha$ to the radial position $r\alpha$. The illustrated position angle $\alpha$ is measured from the x-axis.

A bending direction represents the direction of bending of casing 14 or structure 26. The bending direction is represented by a bending angle $\beta$ that is measured relative to the x axis. A reference angle $\phi$ is measured between bending angle $\beta$ and position angle $\alpha$. A radius of curvature R that corresponds to bending of casing 14 has a direction that is substantially perpendicular to bending angle $\beta$.

Here, each of casing 14 and structure 26 has a cylindrical coordinate system and the coordinate systems are related by the distance and direction between z-axes of the coordinate systems.

As structure 26 is configured to deform as a function of deformation of casing 14, radius of curvature $R_2$ of structure 26 and radius of curvature $R_1$ of casing 14 extend substantially from the same axis and are substantially parallel to one another. As such, radius of curvature $R_1$ and radius of curvature $R_2$ are geometrically related. This relationship can be used to relate the deformation of structure 26 to the deformation of casing 14.

Deformation

An exemplary force F causing deformation of casing 14 and structure 26 is illustrated in FIGS. 1 and 4. Deformation of casing 14 can occur as casing 14 is subject to shear forces and compaction forces that are exerted by formation 12 or by the inflow of fluid between formation 12 and casing 14.

Measurement of Deformation by String

For purposes of teaching, string 22 is described as being an optical fiber and sensors 24 are described as being fiber Bragg gratings. Referring to FIG. 6, string 22 outputs a wavelength response $\lambda_{n,2}$, which is data representing reflected wavelengths $\lambda_r$. The reflected wavelengths $\lambda_r$ each represent a fiber strain $\epsilon_r$ measurement at a sensor 24. Generally described, each reflected wavelength $\lambda_r$ is substantially equal to a Bragg wavelength $\lambda_b$ plus a change in wavelength $\Delta\lambda$. As such, each reflected wavelength $\lambda_r$ is substantially equal to Bragg wavelength $\lambda_b$ when the measurement of fiber strain $\epsilon_r$ is substantially zero and, when the measurement of fiber strain $\epsilon_r$ is non-zero, reflected wavelength $\lambda_r$ differs from Bragg wavelength $\lambda_b$ by change in wavelength $\Delta\lambda$. Accordingly, change in wavelength $\Delta\lambda$ is the part of reflected wavelength $\lambda_r$ that is associated with fiber strain $\epsilon_r$ and Bragg wavelength $\lambda_b$ provides a reference from which change in wavelength $\Delta\lambda$ is measured.

Relationship Between Change in Wavelength and Strain

An equation that can be used to relate change in wavelength $\Delta\lambda$ and fiber strain $\epsilon_r$ imposed on each of sensors 24 is given by $\Delta\lambda=\lambda_b(1-Pe)K\epsilon_f$. As an example, Bragg wavelength $\lambda_b$ may be approximately 1560 nanometers. The term $(1-P_e)$ is a fiber response which, for example, may be 0.8. Bonding coefficient K represents the bond of sensor 24 to structure 26 and, for example, may be 0.9 or greater.

The fiber strain $\epsilon_r$ measured by each of sensors 24 may be generally given by $$\varepsilon_f = -1 + \sqrt{\sin^2\theta\cdot\left(1-\left(\varepsilon_a - \frac{r\cos\phi}{R}\right)\right)^2 + \cos^2\theta\cdot\left(1+\nu\left(\varepsilon_a - \frac{r\cos\phi}{R}\right)\right)^2}$$

Figure 7:
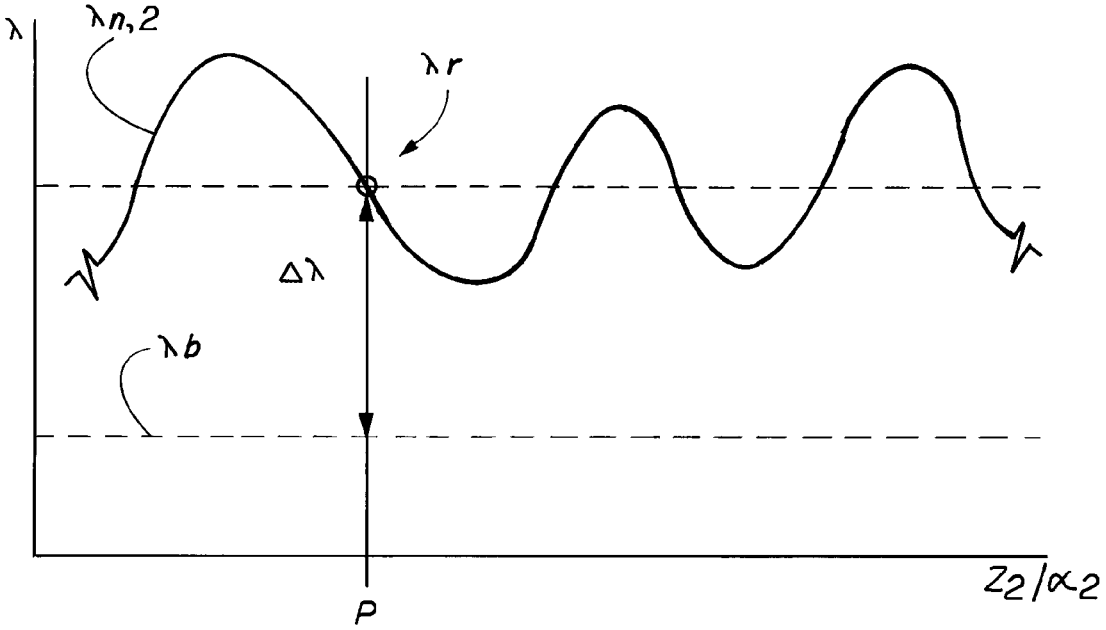
FIG. 7 is a graph illustrating an exemplary signal measured by the system of FIG. 1.

Continuing with FIGS. 6 and 7, for the illustrated system, fiber strain $\epsilon_{f,2}$ measured by each sensor 24 is a function of axial strain $\epsilon_{a,2}$, radius of curvature $R_2$, Poisson's ratio v, wrap angle $\theta$, and the position of sensor 24 which is represented in the equation by radius $r_2$ and reference angle $\phi_2$. Fiber strain $\epsilon_{f,2}$ is measured, wrap angle $\theta$ is known, radius $r_2$ is known, and position angle $\alpha_2$ is known. Poisson's ratio v is typically known for elastic deformation of casing 14 and may be unknown for non-elastic deformation of casing 14. Radius of curvature $R_2$, reference angle $\phi_2$, and axial strain $\epsilon_{a,2}$ are typically unknown and are determined through analysis of wavelength response $\lambda_{n,2}$ of string 22.

Analysis of Wavelength Response

Continuing with FIG. 7, exemplary wavelength response $\lambda_{n,2}$ of string 22 is plotted on a graph. The reflected wavelengths $\lambda_r$ are plotted with respect to radial positions of sensors 24. Generally described, in response to axial strain $\epsilon_{a,2}$ on structure 26, wavelength response $\lambda_{n,2}$ is typically observed as a constant (DC) shift from Bragg wavelength $\lambda_b$. In response to bending of structure 26 that corresponds to a radius of curvature $R_2$, wavelength response $\lambda_{n,2}$ is typically observed as a sinusoid (AC). A change in Poisson's ratio v modifies both the amplitude of the axial strain $\epsilon_{a,2}$ shift and the amplitude of the sinusoids. In any case, signal processing can be used to determine axial strain $\epsilon_{a,2}$, radius of curvature $R_2$, and reference angle $\phi_2$ at sensor 24 positions. Examples of applicable signal processing techniques include inversion, minimizing a misfit, and turbo boosting. The signal processing method can include formulating wavelength response $\lambda_{n,2}$ as the superposition of a constant shift and a sinusoid.

Exemplary Method of Processing

System 20 is configured to obtain a wavelength response $\lambda_{n,2}$ that can be processed to determine information about the deformation of casing 14. In general, as structure 26 is coupled to casing 14, measurements of the deformation of structure 26 can be used to provide information about the deformation of casing 14. The deformation of casing 14 can be derived as a function of the deformation of structure 26 and measurements of the deformation of structure 26 can then be used to provide information about the deformation of casing 14. For example, the bending of casing 14 can be derived as a function of the bending of structure 26 and the axial strain of casing 14 can be derived as a function of the axial strain of structure 26.

An exemplary method of determining a value for fiber strain $\epsilon_{f,1}$ at a position on casing 14 includes determining values for parameters associated with structure 26 including bending angle $\beta_2$, radius of curvature $R_2$, and axial strain $\epsilon_{a,2}$. A value of each of these parameters can be determined from wavelength response $\lambda_{n,2}$. Referring to FIGS. 6 and 7, a value of bending angle $\beta_2$ can be determined by identifying a position P of a sensor 24 where the sinusoidal (AC) aspect of the wavelength response $\lambda_{n,2}$ is substantially equal to zero and analyzing the change in the wavelength response $\lambda_{n,2}$ with respect to change in position at position P.

A value of radius of curvature $R_2$ can be determined, for example, by analyzing the sinusoidal (AC) aspect of the wavelength response $\lambda_{n,2}$. Using the value of bending angle $\beta_2$ to determine values of reference angle $\phi_2$, the equation for fiber strain $\epsilon_{f,2}$ can be used to determine a value the radius of curvature $R_2$. Here, axial strain $\epsilon_{a,2}$ is considered to be substantially equal to zero and all other variables of the equation other than radius of curvature $R_2$ are known, measured, or estimated.

Values of bending angle $\beta_2$ and radius of curvature $R_2$ can then be used to determine values of bending angle $\beta_1$ and radius of curvature $R_1$. Structure 26 is configured to deform along with deformation of casing 14 and, accordingly, bending angle $\beta_2$ is substantially equal to bending angle $\beta_1$ and radius of curvature $R_1$ is substantially parallel to radius of curvature $R_2$. As such, radius of curvature $R_1$ is geometrically related to or otherwise a function of radius of curvature $R_2$ and the value of radius of curvature $R_2$ can be used to determine a value of radius of curvature $R_1$.

A value of axial strain $\epsilon_{a,2}$ can be determined, for example, by analyzing the constant shift (DC) aspect of the wavelength response $\lambda_{n,2}$. The equation for fiber strain $\epsilon_{f,2}$ can be used to determine a value for axial strain $\epsilon_{a,2}$ as radius of curvature $R_2$ is considered to be substantially infinite and all other elements of the equation are known or estimated. Axial strain $\epsilon_{a,1}$ is substantially equal to or otherwise a function of axial strain $\epsilon_{a,2}$ and thus the value of axial strain $\epsilon_{a,2}$ can be used to determine a value of axial strain $\epsilon_{a,1}$.

The value of each of bending angle $\beta_1$, radius of curvature $R_1$, and axial strain $\epsilon_{a,1}$ provides information about the deformation of casing 14. Additionally, once values of bending angle $\epsilon_1$, radius of curvature $R_1$, and axial strain $\epsilon_{a,1}$ have been determined, values for fiber strain $\epsilon_{f,1}$ at positions on casing 14 can be calculated to obtain additional information about the deformation of casing 14.

ALTERNATIVE EMBODIMENTS

In alternative embodiments, a system for detecting and monitoring deformation of a casing can include multiple structures that are configured to deform along with deformation of the casing, each with a measurement device such as a string of sensors. In addition, certain alternative embodiments include a structure with multiple strings of sensors (FIG. 5). One advantage of a system 20 that includes multiple strings 22 is that there is added redundancy in case of failure of one of strings 22. Another advantage is that the data collected with multiple strings 22 makes recovery of a 3-D image an over-determined problem, thereby improving the quality of the image.

The strings 22 of the system 20 can be configured at different wrap angles $\theta$. Using different wrap angles can expand the range of strain that the system 20 can measure. The use of multiple strings 22 with different wrap angles $\theta$ also facilitates determining Poisson's ratio v. Poisson's ratio v may be an undetermined parameter where casing 14 nonelastically deforms or yields under higher strains. For example, where casing 14 is steel, Poisson's ratio v may be near 0.3 while deformation is elastic, but trends toward 0.5 after deformation becomes non-elastic and the material yields.

In still other alternative embodiments, structure 26 can be connected to casing 14 with a rigid member. In such embodiments, casing 14 and structure 26 are not in direct contact although the rigid member connects structure 26 and casing 14 such that structure 26 deforms along with deformation of casing 14. For example, the rigid member can be a beam.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A system for use in a well in a formation, comprising:

a length of casing configured to reinforce a wall of the well;

a structure that is configured to deform with deformation of the casing, said structure being affixed to the length of casing at substantially the same radial position along the length of casing, whereby the structure and the casing have substantially parallel longitudinal axes; and a sensing device that is configured to measure deformation of the structure, said device comprising a string of sensors wrapped around the structure such that the sensors are distributed along both the length of said structure and the perimeter of said structure.

2. The system of claim 1 wherein the structure is in contact with the casing.

3. The system of claim 1 wherein the structure is attached to the casing.

4. The system of claim 1 wherein deformation of the casing comprises axial strain and the structure is configured such that the axial strain of the structure is a function of the axial strain of the casing.

5. The system of claim 1 wherein the structure is configured such that the radius of curvature of the structure is a function of the radius of curvature of the casing.

6. The system of claim 1 wherein the structure is arranged such that at least a longitudinal half of the casing is free of the structure such that a perforating operation in said longitudinal half would not damage such structure.

7. The system of claim 1 wherein the structure includes at least one groove and the at least one string of sensors is at least partially recessed in the at least one groove of the structure.

8. The system of claim 1 wherein the string is substantially helically wrapped around the structure.

9. The system of claim 1 wherein the casing supports the wall of the well.

10. The system of claim 1 wherein the plurality of sensors includes an optical fiber that includes periodically written wavelength reflectors.

11. The system of claim 10 wherein the periodically written wavelength reflectors are reflective gratings.

12. The system of claim 11 wherein the wavelength reflectors are fiber Bragg gratings.

13. A method of detecting deformation of a casing, comprising deploying the system of claim 1 a well in a formation, and processing measurements representing deformation of the structure, wherein the structure is configured to deform along with deformation of the casing such that at least a second parameter that represents the deformation of the structure is a function of at least a first parameter that represents the deformation of the casing.

14. The method of claim 13 wherein the processing step comprises determining a value of the first parameter that represents the deformation of the casing.

15. The method of claim 13 wherein the first parameter and the second parameter each comprise one of fiber strain, bending angle, axial strain, and radius of curvature.

16. The method of claim 13, further comprising obtaining strain measurements at positions that are distributed with respect to the length and perimeter of the structure.

* * * * *